US008055151B2

(12) United States Patent
Asahina et al.

(10) Patent No.: US 8,055,151 B2
(45) Date of Patent: Nov. 8, 2011

(54) OPEN-CLOSE APPARATUS AND IMAGE FORMING APPARATUS

(75) Inventors: Keita Asahina, Saitama (JP); Naomasa Okimura, Saitama (JP); Satoru Hori, Saitama (JP); TaeSung Kim, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/865,803

(22) Filed: Oct. 2, 2007

(65) Prior Publication Data

US 2008/0080893 A1 Apr. 3, 2008

(30) Foreign Application Priority Data

Oct. 3, 2006 (JP) ..... 2006-271667

(51) Int. Cl.
*G03G 15/00* (2006.01)

(52) U.S. Cl. ..... 399/110

(58) Field of Classification Search ..... 399/110, 399/107, 124, 125

See application file for complete search history.

(56) References Cited

U.S. PATENT DOCUMENTS

| | | | | |
|---|---|---|---|---|
| 3,722,142 | A * | 3/1973 | Anderberg et al. | 49/248 |
| 5,379,092 | A * | 1/1995 | Takashima | 399/125 |
| 6,055,394 | A * | 4/2000 | Suda et al. | 399/107 |
| 6,425,206 | B1 * | 7/2002 | Noda et al. | 49/360 |
| 7,433,629 | B2 * | 10/2008 | Tomatsu | 399/125 |
| 7,474,863 | B2 * | 1/2009 | Kaiga | 399/90 |
| 2006/0029424 | A1 * | 2/2006 | Kawai et al. | 399/125 |
| 2006/0120756 | A1 * | 6/2006 | Ahn et al. | 399/124 |
| 2007/0177226 | A1 * | 8/2007 | Ishida et al. | 358/474 |

FOREIGN PATENT DOCUMENTS

| | | | | |
|---|---|---|---|---|
| JP | 56107266 | A | * | 8/1981 |
| JP | 61110212 | A | * | 5/1986 |
| JP | 03134472 | A | * | 6/1991 |
| JP | 05-004727 | A | | 1/1993 |
| JP | 05004727 | A | * | 1/1993 |
| JP | 2835212 | B2 | | 10/1998 |
| JP | 11-084982 | A | | 3/1999 |
| JP | 11263563 | A | * | 9/1999 |
| JP | 2001-147566 | A | | 5/2001 |
| JP | 2001163470 | A | * | 6/2001 |
| JP | 2001-336523 | A | | 12/2001 |
| JP | 2003-207977 | A | | 7/2003 |
| JP | 2003-207978 | A | | 7/2003 |
| JP | 200445585 | A | | 2/2004 |
| JP | 2006274541 | A | * | 10/2006 |
| JP | 2007135990 | A | * | 6/2007 |
| JP | 2007212528 | A | * | 8/2007 |

OTHER PUBLICATIONS

Computer Translation of Watanabe et al.; Publication JP05-004727A (application Nos. JP03-183170 and JP2835212B2).*

Computer Translation of Watanabe et al.; Publication JP05-004727A (application Nos. JP03-183170 and JP2835212B2); Jan. 1993.*

Japanese Notification of Reasons for Refusal Sep. 15, 2010 for Japanese Application No. 2006-271667 with English translation.

JP Office Action for JP2006-271667 dated Feb. 15 2011.

* cited by examiner

*Primary Examiner* — Quana M Grainger
(74) *Attorney, Agent, or Firm* — Sughrue Mion, PLLC

(57) ABSTRACT

An open-close apparatus includes: a first member movably provided with respect to an apparatus main body; a second member movable with respect to the first member, and movably provided with respect to the apparatus main body; and a limiting section, provided between the first and second members, that limits a moving speed of the first and second members.

23 Claims, 12 Drawing Sheets

OPEN-CLOSE APPARATUS AND IMAGE FORMING APPARATUS

CROSS-REFERENCE TO RELATED APPLICATIONS

This application is based on and claims priority under 35 USC 119 from Japanese Patent Application No. 2006-271667 filed Oct. 3, 2006.

BACKGROUND

1. Technical Field

The present invention relates to an open-close apparatus and an image forming apparatus.

2. Related Art

A technique used in an open-close apparatus or image forming apparatus using a member or unit movably provided with respect to an open-close apparatus main body or image forming apparatus main body is known.

SUMMARY

According to an aspect of the invention, there is provided an open-close apparatus including: a first member movably provided with respect to an apparatus main body; a second member movable with respect to the first member, and movably provided with respect to the apparatus main body; and a limiting section, provided between the first and second members, that limits a moving speed of the first and second members.

BRIEF DESCRIPTION OF THE DRAWINGS

Exemplary embodiments of the present invention will be described in detail based on the following figures, wherein.

DETAILED DESCRIPTION

Next, exemplary embodiments of the present invention will be described based on the drawings.

Figure 1:
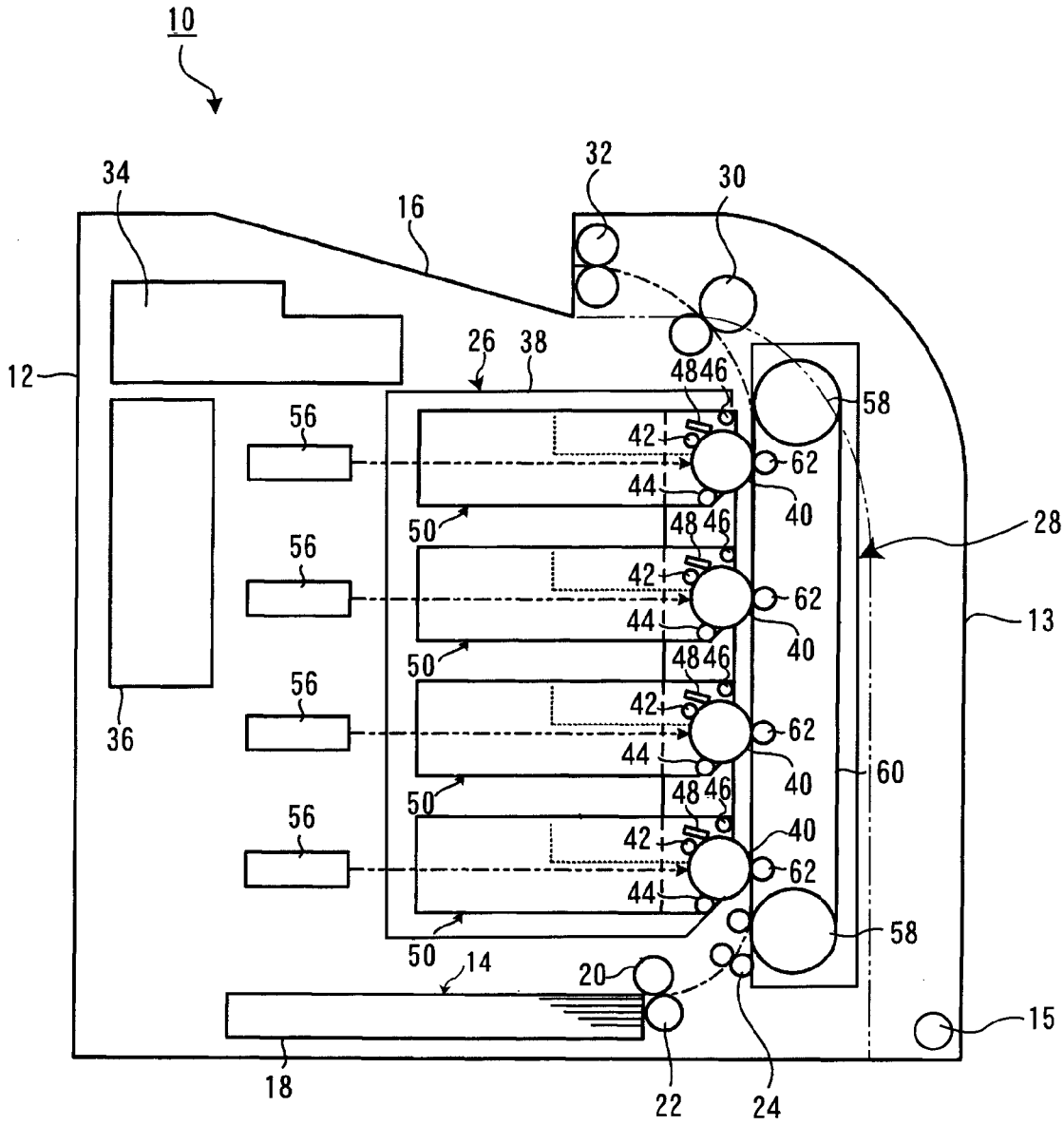
FIG. 1 is a cross-sectional view schematically showing a structure of an image forming apparatus according to a first exemplary embodiment of the present invention.

FIG. 1 shows an image forming apparatus 10 according to a first exemplary embodiment of the present invention. The image forming apparatus 10 has an image forming apparatus main body 12 used as an apparatus main body. A sheet feeding device 14 is provided in a lower part of the image forming apparatus main body 12, and a sheet discharge part 16 is formed in an upper part of the image forming apparatus main body 12.

The sheet feeding device 14 has a sheet tray 18 on which a large number of sheets are stacked. A feed roller 20 is provided at an upper end of the sheet tray 18 and a retard roller 22 is provided in a position opposite to the feed roller 20. A top sheet on the sheet tray 18 is picked up with the feed roller 20 and fed and conveyed by cooperation between the feed roller 20 and the retard roller 22.

The sheet conveyed from the sheet tray 18 is temporarily stopped with a registration roller 24, passed between a photoreceptor unit 26 and a transfer unit 28 to be described later and through a fixing device 30, at predetermined timing, and discharged with a sheet discharge roller 32 to the sheet discharge part 16.

A cover 13, used as a first member and used as an open-close cover, is provided on the front side of the image forming apparatus main body 12. The cover 13 is attached rotatably (movably) with respect to the image forming apparatus main body 12 with a shaft 15 used as a supporting section. The cover 13 rotate-moves with respect to the image forming apparatus main body 12.

The photoreceptor unit 26 used as a third member, the transfer unit 28 used as a second member and used as a unit, a power source unit 34 and a controller 36 are provided in the image forming apparatus main body 12. The photoreceptor unit 26, removably attached in the image forming apparatus main body 12, has a photoreceptor unit main body 38. In the photoreceptor unit main body 38, plural (e.g., four) sub units 50 are supported. The sub units 50 respectively have a photoreceptor 40. A charging device 42, having a charging roller to uniformly charge the photoreceptor 40, used as a charging section, a developing device 44 used as a developing section to develop a latent image written on the photoreceptor 40 with developing material (toner), a destaticizing device 46 used as a destaticizing section to emit light on the photoreceptor 40 after transfer thereby destaticize the photoreceptor 40, and a cleaning device 48 as a developing material removing section to remove developing material remaining on the photoreceptor 40 after transfer, are provided around the photoreceptor 40.

The four sub units 50, as a sub unit for forming a yellow toner image, a sub unit for forming a magenta toner image, a sub unit for forming a cyan toner image and a sub unit for forming a black toner image, from the upstream in a sheet conveyance direction as a gravitational downward direction, form a yellow toner image, a magenta toner image, a cyan toner image and a black toner image on the surfaces of the respective photoreceptors 40. The four sub units 50 are attachable/removable in the photoreceptor unit main body 38.

Optical writing devices 56, respectively having a laser exposure device, are provided in positions corresponding to the respective photoreceptors 40 on the rear surface side of the photoreceptor unit 26. The optical writing devices 56 form latent images by emitting laser to uniformly charged photoreceptors 40.

The transfer unit 28 is provided in a vertical direction opposite to the photoreceptor unit 26 on the front side of the photoreceptor unit 26. In the transfer unit 28, a conveyance belt 60 is put around two supporting rollers 58 provided in the vertical direction. Further, transfer rollers 62 are provided in a position opposite to the respective photoreceptors 40, with the conveyance belt 60 therebetween.

Accordingly, the respective photoreceptors 40 are uniformly charged with the charging devices 42, then latent images are formed with the optical writing devices 56 on the photoreceptors 40, and the latent images are visualized with the developing devices 44 using toner. The toner images formed on the respective photoreceptors 40 are transferred, sequentially from the lowest image, onto a sheet which is being conveyed, with the transfer rollers 62 in the transfer unit 28, and fixed with a fixing device 30 to the sheet.

Figure 2:
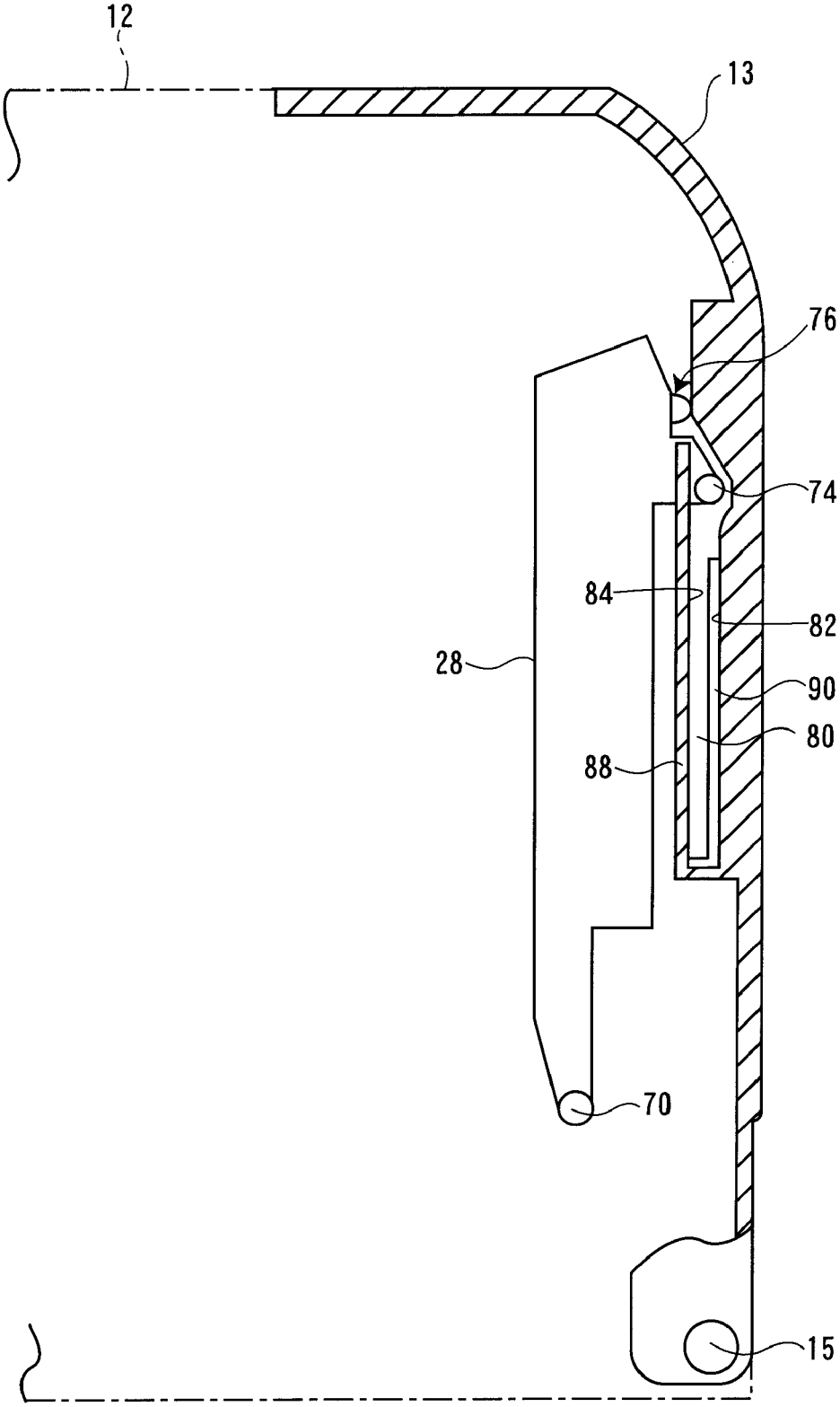
FIG. 2 is a cross-sectional view showing an open-close cover used in the image forming apparatus according to the first exemplary embodiment of the present invention.
Figure 3:
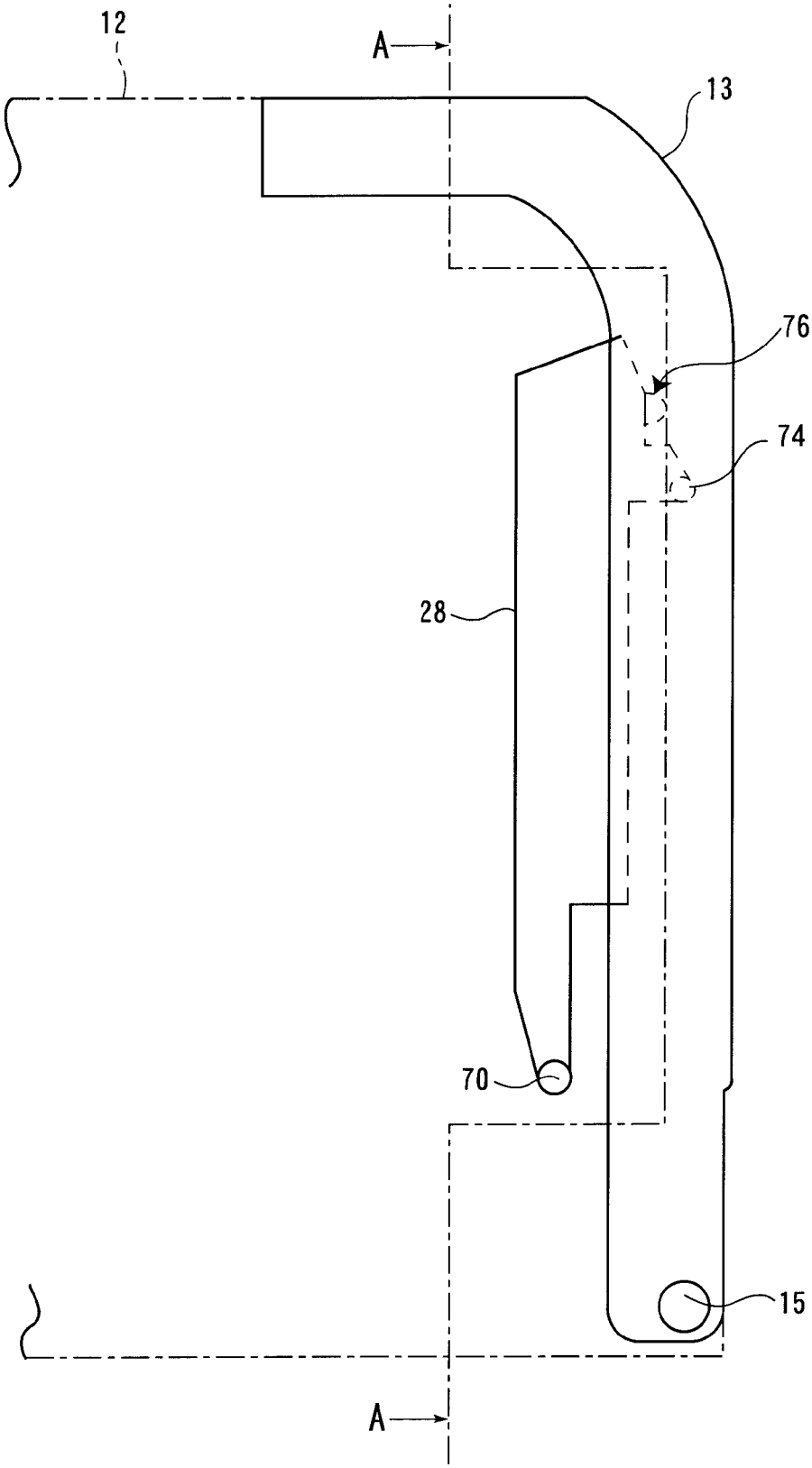
FIG. 3 is a cross-sectional view showing the open-close cover and a transfer unit used in the image forming apparatus according to the first exemplary embodiment of the present invention.
Figure 4:
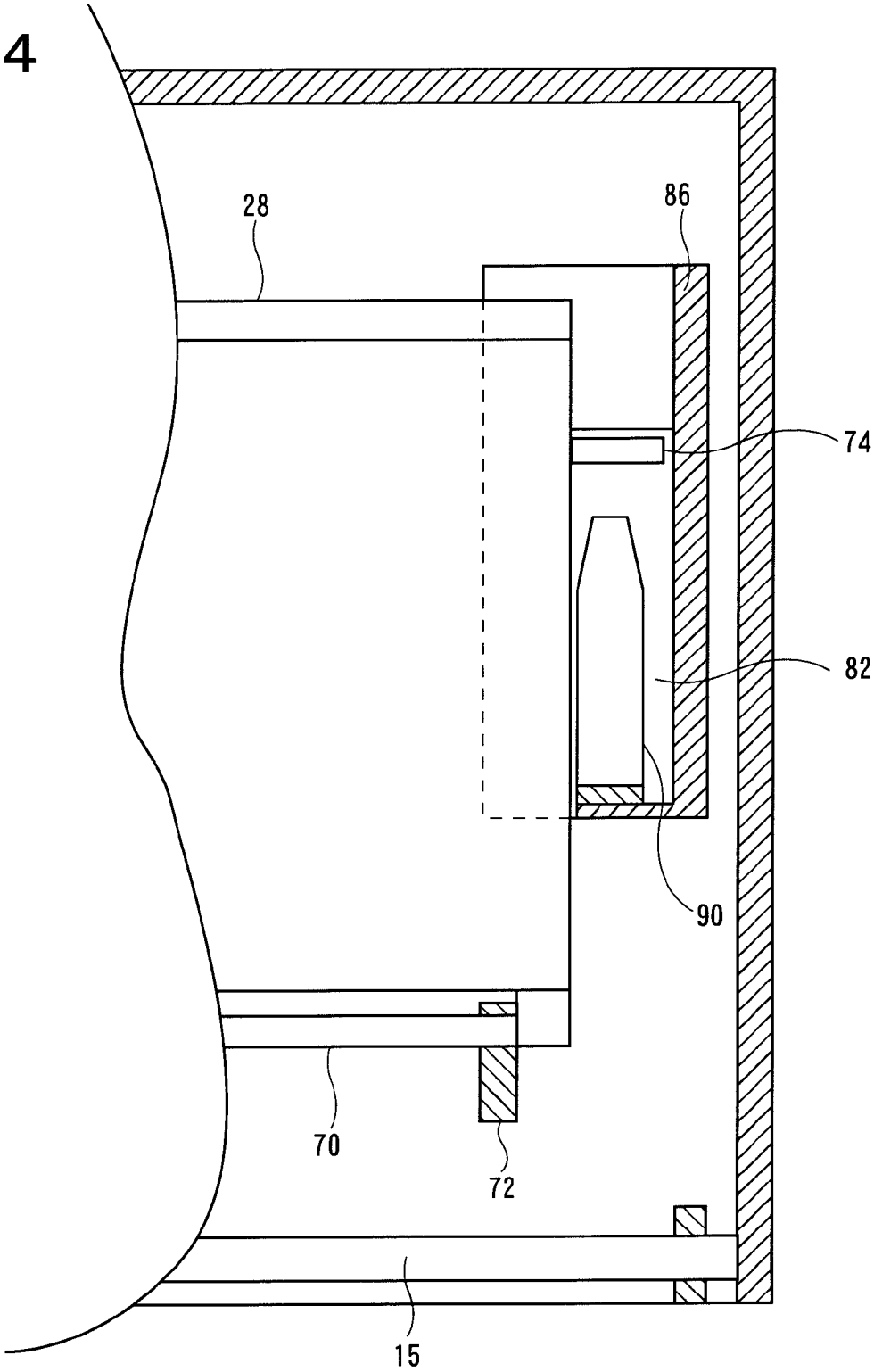
FIG. 4 is a cross-sectional view along a line AA in FIG. 3, showing the open-close cover used in the image forming apparatus according to the first exemplary embodiment of the present invention.

FIGS. 2 to 4 show the details of the transfer unit 28 and the cover 13. A shaft 70 is fixed to the lower end side of the transfer unit 28, and the shaft 70, provided on the image forming apparatus main body 12 side, is rotatably supported with a supporting member 72 formed of, e.g., a main body frame. Although FIG. 4 shows only the supporting member 72 to support the left end side of the shaft 70 in its lengthwise direction, the supporting member 72 is also provided on the right end side of the shaft 70. The shaft 70 is rotatably supported with the supporting members 72. Accordingly, the transfer unit 28 fixed to the shaft 70, rotates about the shift 70, thereby it is movable with respect to the image forming apparatus main body 12.

The transfer unit 28 rotates about the shaft 70, and moves with respect to the image forming apparatus main body 12. On the other hand, the cover 13 rotates about the shaft 15, and moves with respect to the image forming apparatus main body 12. Since the shaft 70 of the transfer unit 28 and the shaft 15 of the cover 13 are provided in different positions, when the cover 13 moves with respect to the image forming apparatus main body 12, the transfer unit 28 also moves with respect to the cover 13.

A projection 74 used as an engaged member is provided on the upper end side of the transfer unit 28. The projection 74, having an e.g. approximately cylindrical shape, is provided on the left side as shown in FIG. 4, and is also provided on the right side of the transfer unit 28.

A pressing mechanism 76 used as a pressing section is provided above the projection 74. The pressing mechanism 76 is provided in right and left positions, thus the two pressing mechanisms 76 press the transfer unit 28 against the photoreceptor unit 26. As the pressing mechanisms 76 press the transfer unit 28 against the photoreceptor unit 26, the conveyance belt 60 and the photoreceptors 40 are in an excellent contact state (see FIG. 1). The details of the pressing mechanism 76 will be described later.

A groove 80 used as an engagement member is formed in the cover 13. The groove 80 is formed with space surrounded by a surface 82 formed on the apparatus inner side of the cover 13 and a surface 84 opposing the surface 82, and has a width slightly wider than an outer diameter of the projection 74. Accordingly, the projection 74 is movable in the groove 80. The surface 84 is a surface opposite to the surface 82, of a projection 88, formed to project toward a central portion of the image forming apparatus 10 in parallel with the surface 82, from a projection 86 projecting toward the apparatus inner side from the cover 13.

The projection 74 is inserted in the groove 80, and the groove 80 and the projection 74 engage with each other. Accordingly, the cover 13 and the transfer unit 28 engage with each other, and the transfer unit 28 moves in accordance with movement of the cover 13.

A limiting plate 90, used as a limiting section, and used as a limiting member, is attached to the surface 82 by e.g. attachment using an adhesive or the like. The details of the limiting plate 90 will be described later. Note that the groove 80, the surface 82, the surface 84, the projection 86, the projection 88 and the limiting plate 90 are respectively provided on both right and left sides of the image forming apparatus 10.

Figure 5A:
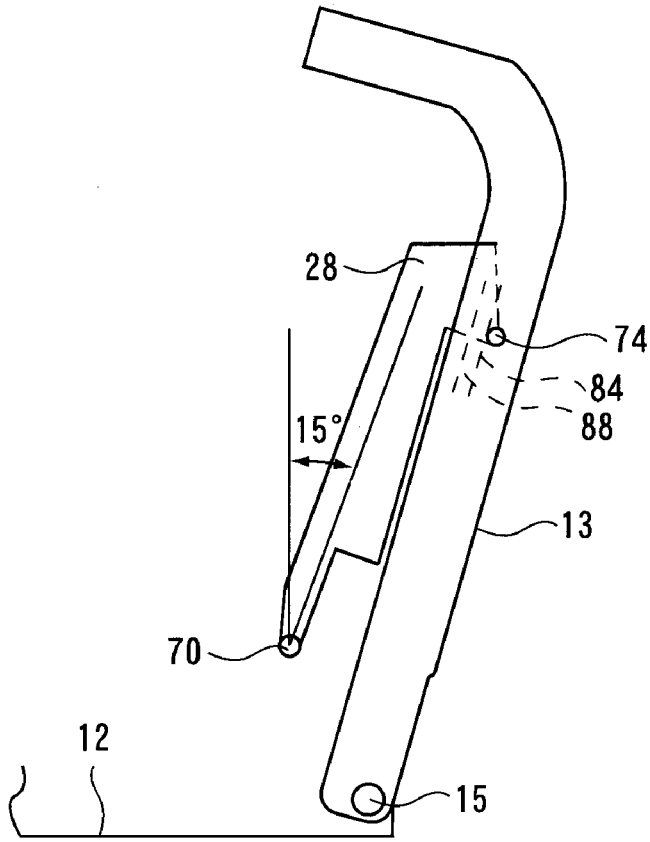
FIG. 5A is a cross-sectional view of the open-close cover and the transfer unit used in the image forming apparatus according to the first exemplary embodiment of the present invention, showing a state where the transfer unit has moved at a 15-degree angle from a position where the transfer unit is used for image formation.
Figure 5B:
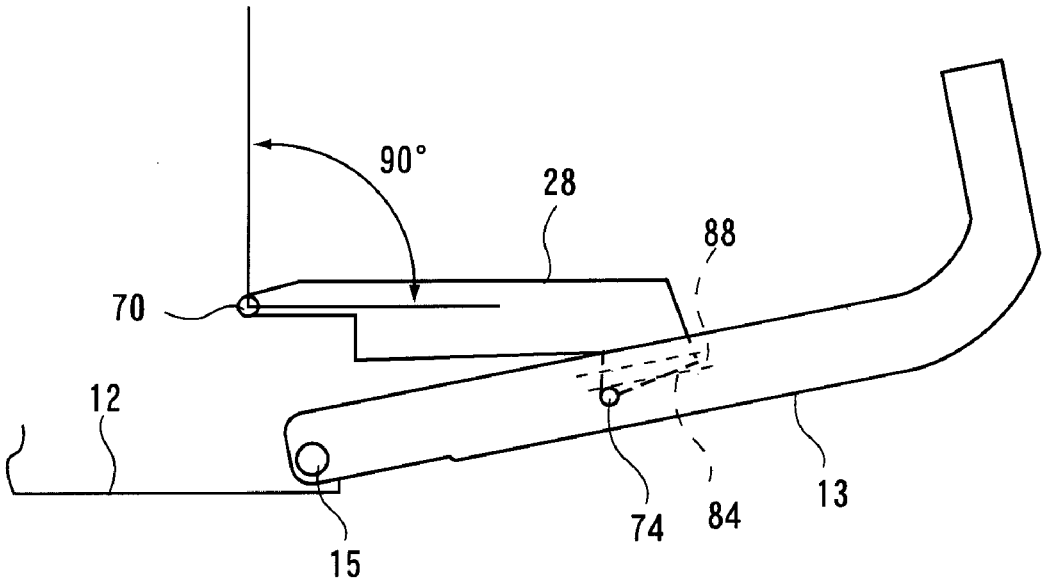
FIG. 5B is a cross-sectional view of the open-close cover and the transfer unit used in the image forming apparatus according to the first exemplary embodiment of the present invention, showing a state where the transfer unit has rotated at a 90-degree angle from the position where the transfer unit is used for image formation.

FIGS. 5A and 5B show movement of the cover 13 and the transfer unit 28 with respect to the image forming apparatus main body 12. In the image forming apparatus 10 having the above structure, when the cover 13, in a closed state (see FIG. 3), is opened by an operator, the cover 13 starts rotation about the shaft 15. Then, when the cover 13 is opened at a predetermined angle, the surface 84 of the projection 88 comes into contact with the projection 74. From this state, when the cover 13 is further opened, the projection 74 is pressed with the surface 84, and the transfer unit 28 starts rotational movement about the shaft 70. After the start of rotation of the transfer unit 28, the projection 74, being guided with the groove 80, moves from the entrance side of the groove 80 toward the back side.

FIG. 5A shows a state where the transfer unit 28 has rotated by 15 degrees from a state where the transfer unit 28 is used for image formation (see FIG. 3). FIG. 5B shows a state where the transfer unit 28 has rotated by 90 degrees from the state where the transfer unit 28 is used for image formation.

Figure 6:
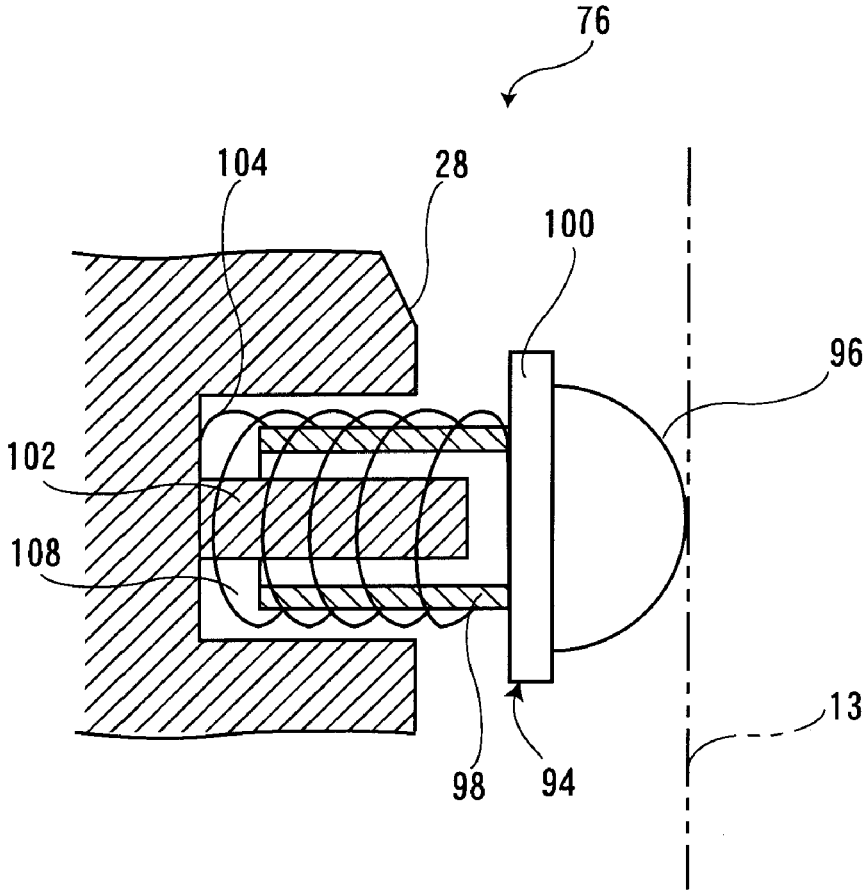
FIG. 6 is a cross-sectional view schematically showing a structure of a pressing mechanism used in the image forming apparatus according to the first exemplary embodiment of the present invention.

FIG. 6 shows the details of the above-described pressing mechanism 76. The pressing mechanism 76 has a moving member 94. The moving member 94 has a contact part 96, a cylindrical part 98, and a coupling part 100 to couple the contact part 96 with the cylindrical part 98. The contact part 96, having e.g. an approximately semispherical shape, comes into contact with the cover 13 and is pressed with the cover 13. The cylindrical part 98 is formed in a cylindrical shape, in which one side opposite to the contact part 96 is opened. A projection 102 is inserted into the cylindrical part 98, thereby the moving member 94 is set in the transfer unit 28. One end of a spring 108 formed of an elastic body, which is used as a pressing member, is fixed to a surface on the cylindrical part 98 side of the coupling part 100.

The projection 102 is provided in a concave part 104 formed in the main body of the transfer unit 28, and used as a guide member to guide movement of the moving member 94. A bottom portion of the concave part 104 is used as a second pressing part, and fixed to an end of the spring 108 opposite to the end fixed to the moving member 94. Accordingly, the moving member 94 is coupled with the transfer unit 28 with the spring 108.

When the transfer unit 28 is in the state where it is used for image formation (see FIG. 2), the contact part 96 of the moving member 94 is pressed with the cover 13 to the left side in FIG. 6. When the moving member 94 is pressed to the left side, the spring 108 is pressed with the moving member 94 to the left side. As the spring 108 is pressed to the left side, the transfer unit 28 is pressed against the photoreceptor unit 26.

Figure 7:
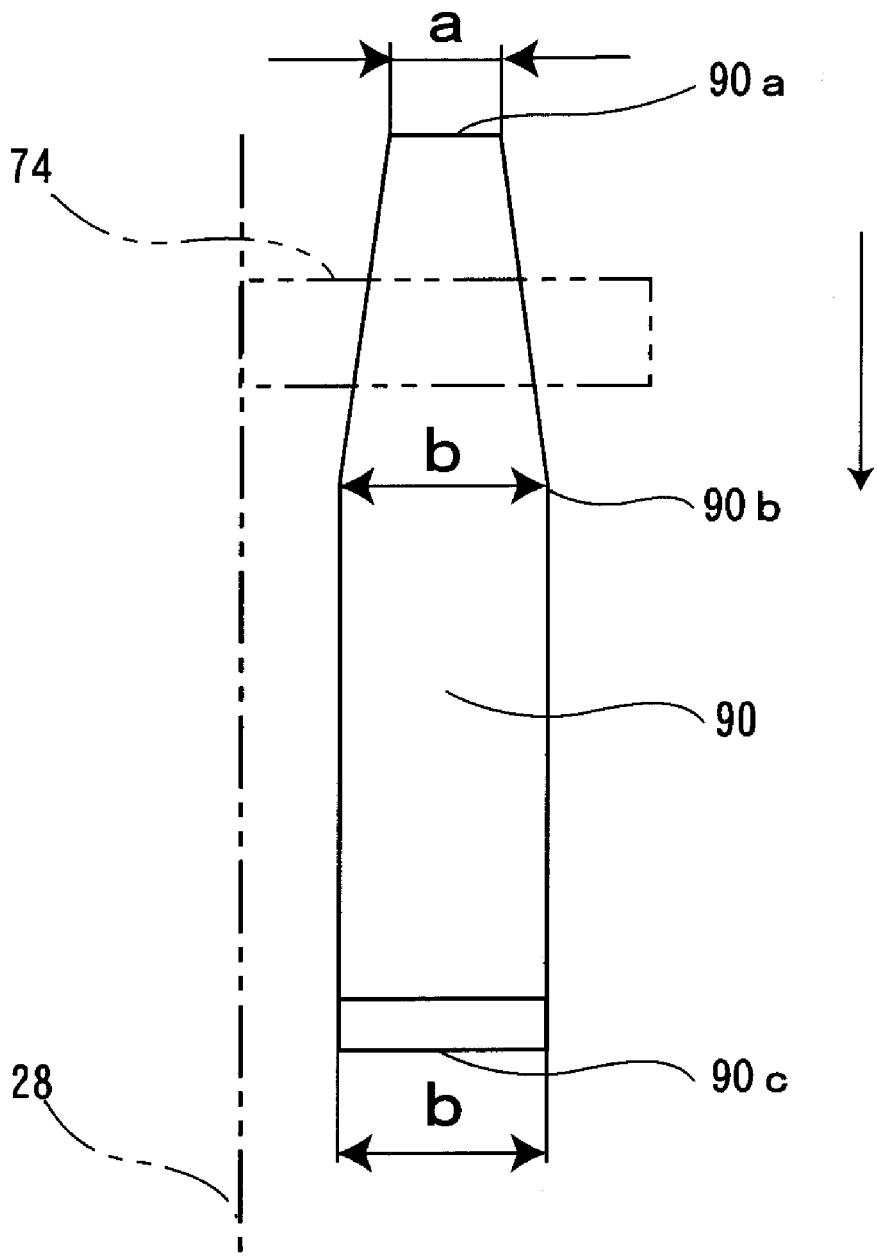
FIG. 7 is an explanatory view of a limiting plate used in the image forming apparatus according to the first exemplary embodiment of the present invention.

FIG. 7 shows the limiting plate 90. The limiting plate 90 is formed of a material having a dynamic coefficient of friction higher than that of the surface 82 of the cover 13. In the limiting plate 90, one end 90*a* has a width a, and the width is linearly increased toward a position 90*b*. The width in the position 90*b* is b. The width from the position 90*b* to the other end 90*c* is the same b.

The limiting plate 90 is attached to the surface 82 of the cover 13 such that the end 90*a* side is positioned on the upper side (see FIGS. 2 and 4). Accordingly, when the operator moves the transfer unit 28 with respect to the image forming apparatus main body 12 and thereby the projection 74 starts movement in the groove 80, then the projection 74 starts to come into contact with the end 90*a* of the limiting plate 90 when the transfer unit 28 has rotated by a predetermined angle. Then, when the transfer unit 28 is further rotated, the projection 74, in contact with the limiting plate 90, moves downward on the surface of the limiting plate 90, passing through the position 90*b*, to the other end 90*c* side.

In the first exemplary embodiment, the attachment position of the limiting plate 90 is determined such that, in the state where the transfer unit 28 has rotated by 15 degrees from the position in which it is used for image formation (hereinbelow, referred to as an "initial position") (see FIG. 5A), the projection 74 arrives at the end 90*a*, and the projection 74 starts to come into contact with the limiting plate 90. Then, in the state where the transfer unit 28 has rotated by 45 degrees from the initial position, the projection 74 arrives at the position 90*b*. Thereafter, when the transfer unit 28 has moved to the position 90 degrees from the initial position, the projection 74 arrives at the other end 90*c*.

When the cover 13 and the transfer unit 28 have started movement and before the transfer unit 28 arrives from the initial position to the 15 degree angle position, the moving speed of the cover 13 and the transfer unit 28 is not limited with the limiting plate 90. When the transfer unit 28 has rotated by 15 degrees from the initial position, since the projection 74 comes into contact with the limiting plate 90 having a dynamic coefficient of friction higher than that of the surface 82, the projection 74 receives a higher friction force in the groove 80. That is, after rotation of the transfer unit 28 by 15 degrees, the moving speed of the transfer unit 28 and the cover 13 is reduced. Accordingly, the impact and damage applied to the movable portions such as the shaft 15, a portion of the cover 13 supported with the shaft 15, the shaft 70 and a portion of the transfer unit 28 supported with the shaft 70, are reduced.

In accordance with the rotation of the transfer unit 28 from the 15 degree angle position to the 45 degree angle position, the projection 74, in contact with the limiting plate 90, moves from the end 90*a* to the position 90*b*. At this time, as the width of the limiting plate 90 is gradually increased, the area of contact between the projection 74 and the limiting plate 90 is gradually increased, and the projection 74 receives a higher friction force from the limiting plate 90.

In this manner, in connection with the movement of the cover 13 and the transfer unit 28, the limiting plate 90 limits the moving speed of the cover 13 and the transfer unit 28 by control of the friction force applied to the cover 13 and the transfer unit 28. That is, in connection with the rotation of the transfer unit 28 to the 15 degree angle position, the friction force applied to the transfer unit 28 and the cover 13 is increased, thereby limitation of the speed of the transfer unit 28 and the cover 13 is started. That is, in connection of the rotation of the transfer unit 28 to the 45 degree angle position, the friction force applied to the transfer unit 28 and the cover 13 is gradually increased, thereby the speed of the transfer unit 28 and the cover 13 is gradually reduced.

As the material of the limiting plate 90, foamed polyurethane as a foamed material in an approximately closed-cell foaming state is used. Note that the foamed material contains air bubbles in the material. By use of the foamed material, the limiting plate 90 can be appropriately deformed, and can excellently absorb the impact upon contact with the projection 74. Further, the approximately closed-cell foaming state means that the bubbles in the material are not connected but approximately independent of each other. As the foamed material in the approximately closed-cell foaming state is used as the material of the limiting plate 90, the air bubbles are not easily deformed even by repeated pressing from the projection 74, and the deformation and wear-out of the limiting plate 90 do not easily occur.

As the material of the limiting plate 90, the foamed polyurethane may be replaced with foamed polystyrene, foamed polyethylene, foamed elastomer, foamed silicone, foamed synthetic rubber or the like. Note that since the projection 74 moves while it is in contact with the surface of the limiting plate 90, the limiting plate 90 may have a double lay structure with an abrasion-resistant surface layer.

Further, the density of the foamed polyurethane used as the material of the limiting plate 90 is approximately 480 $Kg/m^3$. This value is obtained by measurement in conformity with JISK6401. The density of the foamed polyurethane used as the material of the limiting plate 90 may be 240 $Kg/m^3$ or higher and 500 $Kg/m^3$ or lower. When foamed polyurethane having a density of 240 $Kg/m^3$ or higher is used, there is a probability that the projection 74 excessively digs into the limiting plate 90. In such case, the moving speed of the cover 13 and the transfer unit 28 may become too slow, or wear-out may easily occur in the limiting plate 90. On the other hand, when the density is 500 $Kg/m^3$, there is a probability that the impact upon contact with the projection 74 can not be sufficiently absorbed. From the view point of excellent control of the operations of the cover 13 and the transfer unit 28, the view point of prevention of wear-out of the limiting plate 90, and the view point of excellent impact absorption, a material particularly having a density of 320 $Kg/m^3$ or higher and 500 $Kg/m^3$ or lower may be used. In the present exemplary embodiment, as described above, the foamed polyurethane having a density of approximately 480 $Kg/m^3$ is used as the material of the limiting plate 90.

In the first exemplary embodiment, the limiting plate 90 is provided on the groove 80 side, however, it may be arranged such that a member to control the friction force applied to the groove 80 and the projection 74 is provided in at least one of the groove 80 and the projection 74. Further, it may be arranged such that a member to limit the friction force applied to the groove 80 and the projection 74 is provided in the projection 74 instead of providing the limiting plate 90 on the surface 82 of the groove 80 or in addition to providing the limiting plate 90 on the surface 82.

Figure 8:
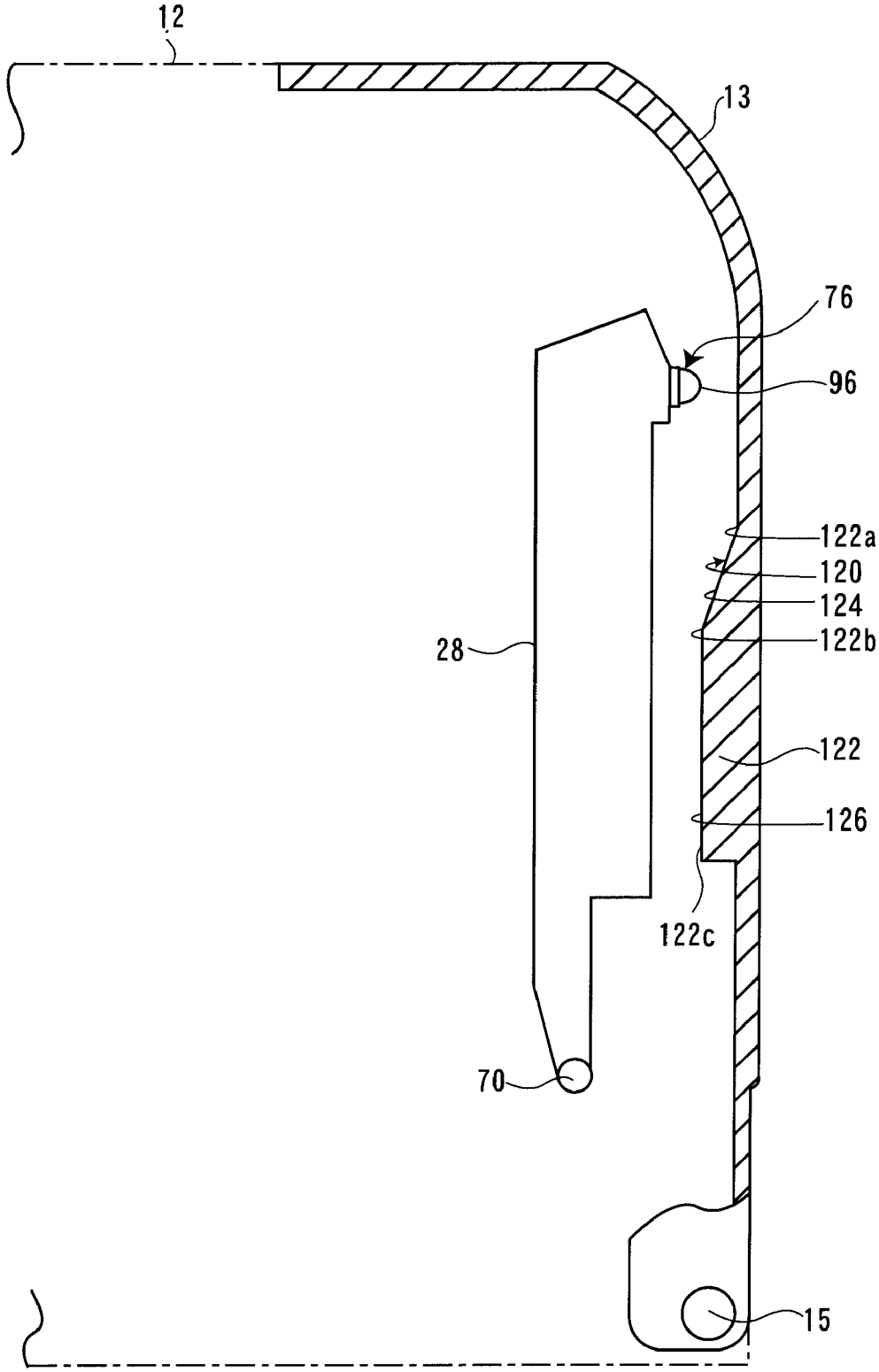
FIG. 8 is a cross-sectional view showing the open-close cover used in the image forming apparatus according to a second exemplary embodiment of the present invention.

FIG. 8 shows the transfer unit 28 and the cover 13 of the image forming apparatus 10 according to a second exemplary embodiment of the present invention. In comparison with the above-described first exemplary embodiment, in the first exemplary embodiment, the area of contact between the limiting plate 90 and the projection 74 is controlled thereby the moving speed of the cover 13 and the transfer unit 28 is limited. On the other hand, in the second exemplary embodiment, the pressing mechanism 76, and a pressing force control mechanism 120 to control a pressing force of the cover 13 to press the contact part 96 used as a limiting member, are used as the limiting section, so as to limit the moving speed of the cover 13 and the transfer unit 28.

The pressing force control mechanism 120 has a convex part 122 provided on the apparatus inner side of the cover 13. The convex part 122 has a shape which rises from an upper end 122*a* and gradually becomes higher to a position 122*b*, and forms a slope 124 used as a first pressing part between the upper end 122*a* and the position 122*b*. Further, the convex part 122 forms a surface 126, which has a fixed height between the position 122*b* and a lower end 122*c* and which is used as the first pressing part similar to the slope 124, between the position 122*b* and the lower end 122*c*. As in the case of the pressing mechanism 76, the pressing force control mechanism 120 is provided on the both right and left sides of the image forming apparatus 10. The explanations of constituent elements identical to those in the first exemplary embodiment will be omitted.

In the second exemplary embodiment having the above structure, when the cover 13 is opened by the operator, the cover 13 starts rotation about the shaft 15. Then, when the cover 13 is opened to a predetermined angle, the contact part 96 of the pressing mechanism 76 comes into contact with the upper end 122*a* side of the convex part 122, and the contact part 96 is pressed with the slope 124 to the transfer unit 28 side. Then, when the contact part 96 is pressed, the transfer unit 28 is pressed with the spring 108 (see FIG. 6) in a direction to move away from the cover 13. The projection 74 of the transfer unit 28 and the projection 88 provided on the cover 13 come into press-contact with each other, thereby the moving speed of the cover 13 and the transfer unit 28 is limited.

Figure 9A:
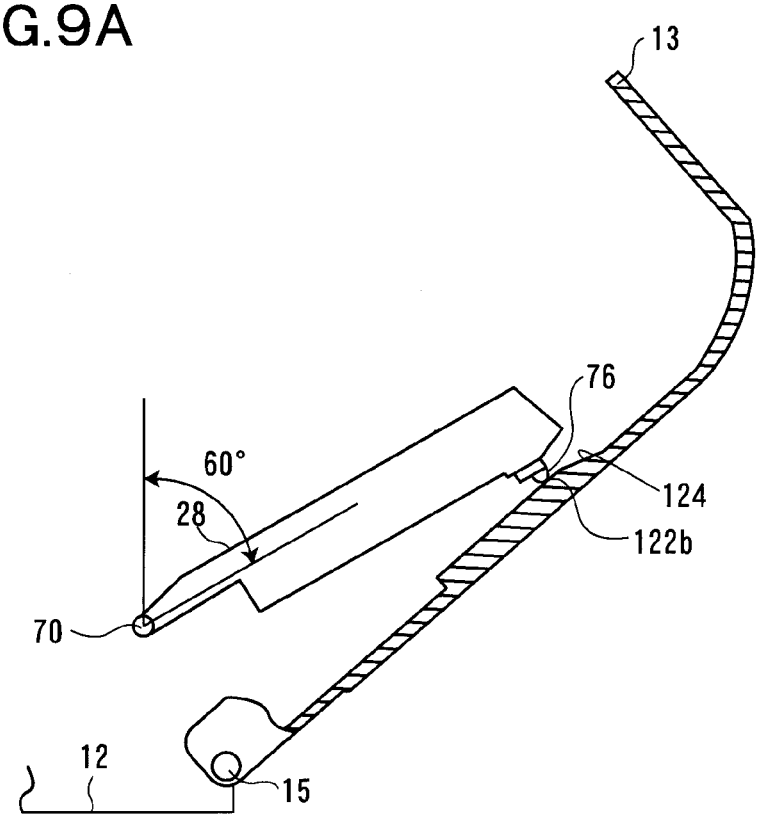
FIG. 9A is a cross-sectional view of the open-close cover and the transfer unit used in the image forming apparatus according to the second exemplary embodiment of the present invention, showing a state where the transfer unit has moved at a 60-degree angle from the position where the transfer unit is used for image formation.

When the cover 13 is further opened, the contact part 96 moves, while sliding on the slope 124, toward the position 122*b*. As shown in FIG. 9A, when the transfer unit 28 moves from the initial position to a 60-degree-angle-rotated position, the contact part 96 arrives at the position 122*b*. While the cover 13 moves to the 60-degree-angle-position, the contact part 96 is gradually pressed with the slope 124 to a position closer to the transfer unit 28, accordingly, the distance between the slope 124 used as the first pressing part and a bottom of the concave part 104 used as a second pressing part (see FIG. 6) gradually becomes shorter, and the pressing force of the projection 74 and the projection 88 by elasticity of the spring 108 gradually becomes larger. As the pressing force of the projection 74 and the projection 88 gradually becomes larger, the moving speed of the cover 13 and the transfer unit 28 is controlled to gradually become slower.

Figure 9B:
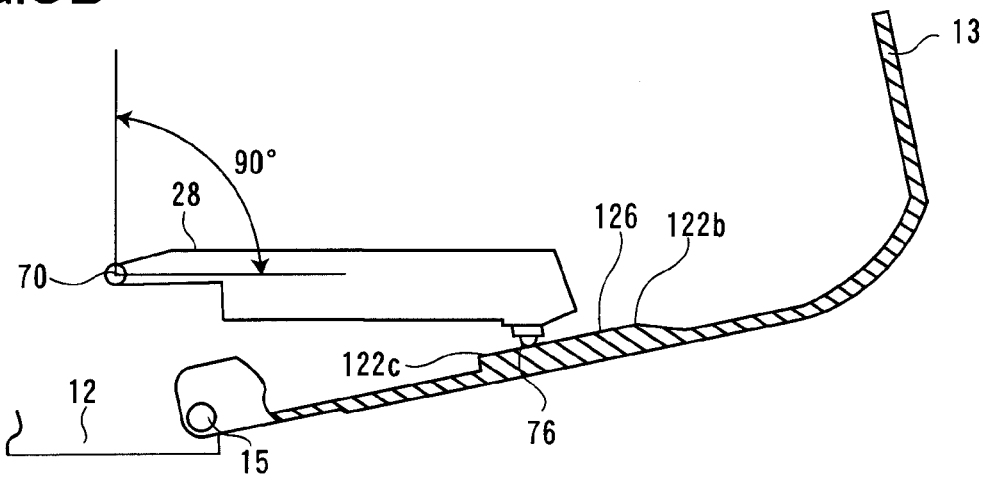
FIG. 9B is a cross-sectional view of the open-close cover and the transfer unit used in the image forming apparatus according to the second exemplary embodiment of the present invention, showing a state where the transfer unit has rotated at a 90-degree angle from the position where the transfer unit is used for image formation.

When the cover 13 is further opened, the contact part 96 moves, while sliding on the surface 126, toward the lower end 122*c* of the convex part 122. FIG. 9B shows a state in which the transfer unit 28 has moved from the initial position to a 90-degree-angle-rotated position. While the transfer unit 28 moves from the position shown in FIG. 9A to the position shown in FIG. 9B, since the height of the convex part 122 is fixed, a predetermined pressing force is applied to the cover 13 and the transfer unit 28.

In the above-described second exemplary embodiment, the limiting plate 90 provided in the first exemplary embodiment is not provided. However, the limiting plate 90 may be provided in the above-described second exemplary embodiment. In this case, it may be arranged such that the limiting plate 90 and the pressing force control mechanism 120 are used so as to limit the moving speed of the cover 13 and the transfer unit 28.

Figure 10:
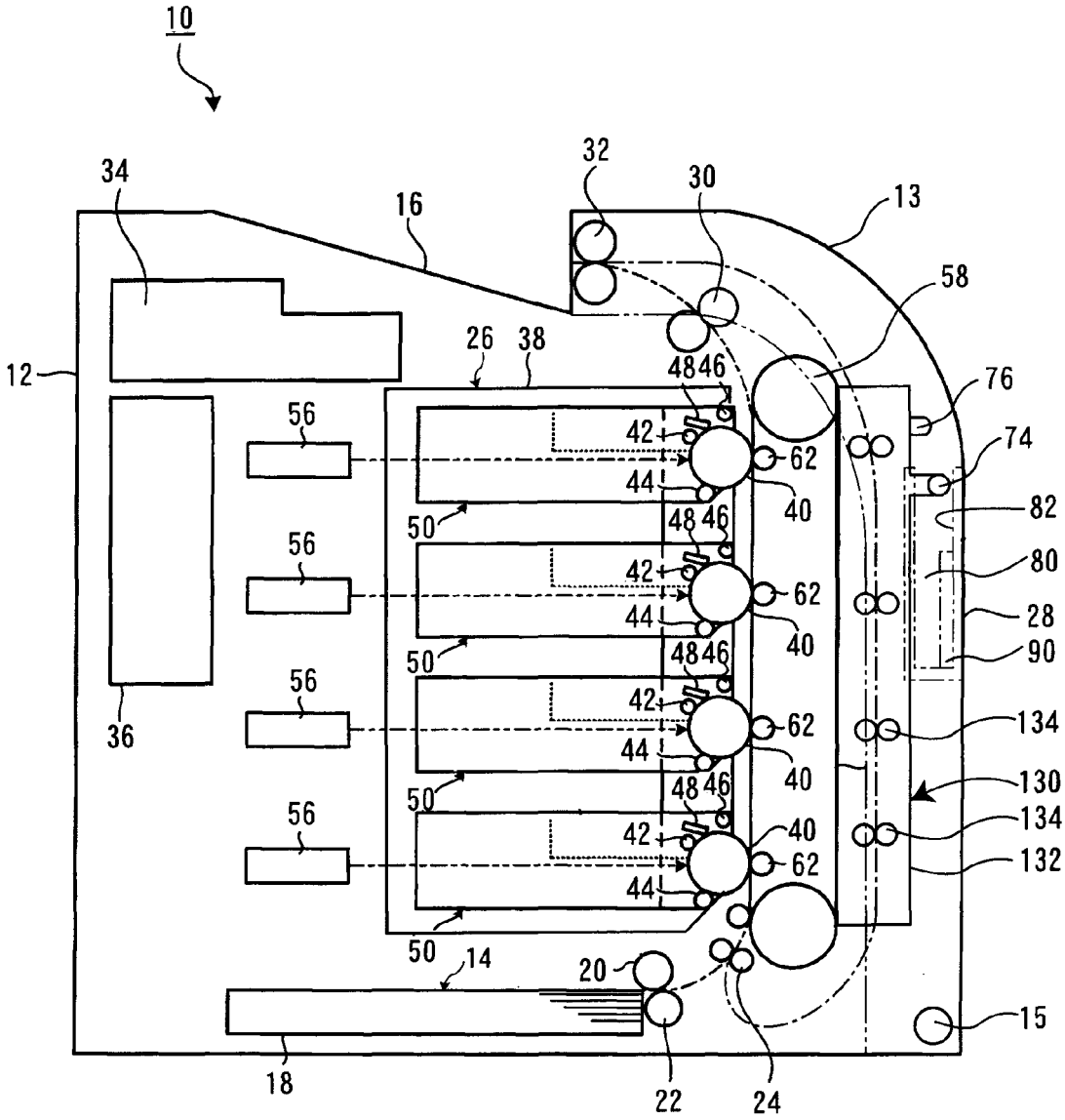
FIG. 10 is a cross-sectional view schematically showing a structure of the image forming apparatus according to a third exemplary embodiment of the present invention.

FIG. 10 shows the image forming apparatus 10 according to a third exemplary embodiment of the present invention. In the first and second exemplary embodiments, the image forming apparatus 10 has the limiting plate 90 or the pressing force control mechanism 120 to limit the moving speed of the cover 13 and the transfer unit 28. On the other hand, in the third exemplary embodiment, the image forming apparatus 10 has a reverse unit 130 to reverse a sheet, and the limiting plate 90 limits the moving speed of the reverse unit 130 and the cover 13.

The reverse unit 130 has a reverse unit main body 132, in which conveyance rollers 134 are provided. A sheet, on one surface of which image formation has been performed, supplied by reverse rotation of the sheet discharge roller 32, is conveyed, while reversed, with the conveyance rollers 134, to the registration roller 24 again. By use of the reverse unit 130, image formation can be performed on both sides of the sheet.

As in the case of the transfer unit 28 in the first example, the reverse unit main body 132 is provided with the projection 74. Further, as in the case of the cover 13 in the first exemplary embodiment, the groove 80 is formed in the cover 13, and the limiting plate 90 is attached to the surface 82 forming the groove 80. As in the case of the first exemplary embodiment, as the projection 74 comes into contact with the limiting plate 90, the moving speed of the cover 13 and the reverse unit 130 is limited. Note that in FIG. 10, the constituent elements identical to those in the first exemplary embodiment have the same reference numerals and the explanations thereof will be omitted.

In the above-described third exemplary embodiment, the moving speed of the cover 13 and the reverse unit 130 is limited by use of the limiting plate 90 as in the case of the first exemplary embodiment. However, the limiting plate 90 may be replaced with the pressing force control mechanism 120 as in the case of the second exemplary embodiment, or the pressing force control mechanism 120 may be added to the structure of the third exemplary embodiment, so as to limit the moving speed of the cover 13 and the transfer unit 28 with the pressing force control mechanism 120.

Figure 11:
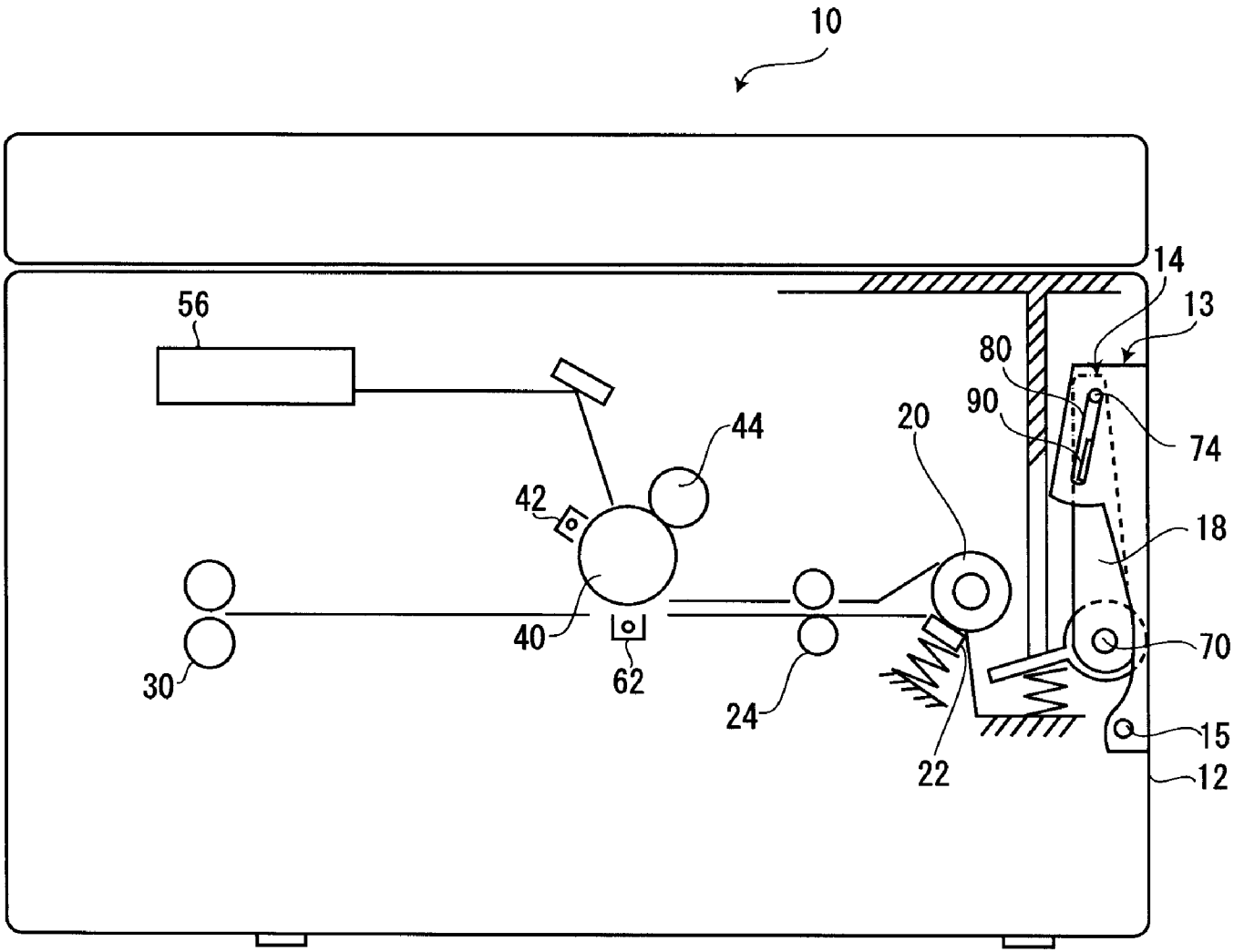
FIG. 11 is a cross-sectional view schematically showing a structure of the image forming apparatus according to a fourth exemplary embodiment of the present invention.
Figure 12:
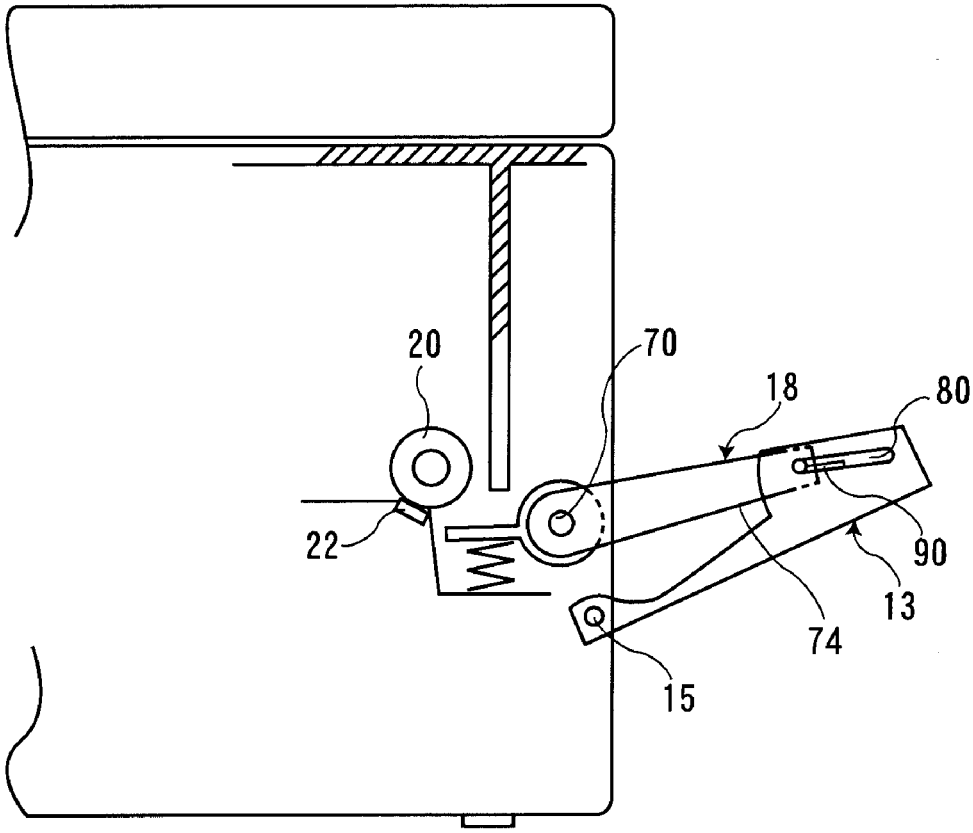
FIG. 12 is a cross-sectional view explaining an operation of the image forming apparatus according to the fourth exemplary embodiment of the present invention when a sheet tray is opened.

FIGS. 11 and 12 show the image forming apparatus 10 according to a fourth exemplary embodiment of the present invention. The image forming apparatus 10 has the image forming apparatus main body 12, and the sheet feeding device 14 is provided in a side part of the image forming apparatus main body 12. Further, the image forming apparatus main body 12 includes the photoreceptor 40, the charging device 42 to uniformly charge the photoreceptor 40, the optical writing device 56 to perform optical writing on the photoreceptor 40 charged with the charging device 42, the developing device 44 to develop a latent image written with the optical writing device 56, a transfer device 62 to transfer a developing material image formed with the developing device 44 to a sheet, and the fixing device 30 to fix the developing material image, transferred to the sheet with the transfer device 62, to the sheet.

The sheet feeding device 14 used as a unit has the sheet tray 18 used as a second member, on which a large number of sheets are stacked. The sheet tray 18 is provided rotatably with respect to the image forming apparatus main body 12 with the shaft 70. The sheet tray 18 moves between a position inside the image forming apparatus main body 12 shown in FIG. 11 and a use position shown in FIG. 12.

The feed roller 20 is provided on the left side of the sheet tray 18 in FIG. 11, and a retard pad 22 is provided in a position opposite to the feed roller 20. A top sheet on the sheet tray 18 is picked up with the feed roller 20, and the sheet is retarded and conveyed by cooperation between the feed roller 20 and the retard pad 22. The registration roller 24 is provided downstream of the feed roller 20 in the sheet conveyance direction.

The image forming apparatus main body 12 is provided with the cover 13 as a first member, used as an open-close cover. The cover 13 is attached rotatably (movably) to the image forming apparatus main body 12 with the shaft 15 used as a supporting section.

In the first exemplary embodiment, the image forming apparatus 10 has the limiting plate 90 to limit the moving speed of the cover 13 and the transfer unit 28. On the other hand, in the fourth exemplary embodiment, the limiting plate 90 is used for limiting the moving speed of the sheet tray 18 and the cover 13. That is, as in the case of the first exemplary embodiment, the groove 80 is formed in the cover 13. Further, the limiting plate 90 is attached to the surface forming the groove 80.

As in the case of the transfer unit 28 in the first exemplary embodiment, the sheet tray 18 is provided with the projection 74. As the projection 74 is inserted into the groove 80 and the projection 74 comes into contact with the limiting plate 90, the moving speed of the cover 13 and the sheet tray 18 is limited.

In the above-described fourth exemplary embodiment, the moving speed of the cover 13 and the sheet tray 18 is limited by use of the limiting plate 90 as in the case of the first exemplary embodiment. However, the limiting plate 90 may be replaced with the pressing force control mechanism 120 as in the case of the second exemplary embodiment, or the pressing force control mechanism 120 may be added to the structure of the third exemplary embodiment, so as to limit the moving speed of the cover 13 and the sheet tray 18 with the pressing force control mechanism 120. Note that the explanations of the constituent elements identical to those in the first exemplary embodiment will be omitted.

As described above, the present invention is applicable to an image forming apparatus having a unit provided movably with respect to an image forming apparatus main body such as a transfer unit. Further, the present invention is applicable to, not only the image forming apparatus, but an open-close apparatus having an apparatus main body and a member provided movably with respect to the apparatus main body.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An open-close apparatus comprising:

a first member provided with respect to an apparatus main body and movable between an open position and a close position thereof; and a second member movable with respect to the first member, and movably provided with respect to the apparatus main body, wherein when the first member moves from the close position to the open position:

when a movement of the first member is smaller than a predetermined amount from the close position, a moving speed of the first member is not limited, and when the movement of the first member is the same as or larger than the predetermined amount from the close position, the moving speed of the first member is limited, and wherein one of the first member and the second member has a groove, and the other of the first member and the second member has a projection, and the groove has a first end and a second end, wherein when the first member moves from the close position to the open position, the moving speed of the first member is limited at a portion between the close position and the open position by the groove engaging the projection between the first end and the second end, wherein the groove has a first portion that is linear and a second portion that is continuous with the linear portion and angled at a different angle as an angle of the first portion, wherein when the movement of the first member is smaller than the predetermined amount, the projection is located in the first portion of the groove and the moving speed of the first member is not limited, and wherein when the movement of the first member is the same as or larger than the predetermined amount, the projection moves along the second portion and the moving speed of the first member is limited.

2. The open-close apparatus according to claim 1, wherein the second portion of the groove has a slope.

3. The open-close apparatus according to claim 1, wherein the groove and the projection limit the moving speed of the first member by a friction force caused between the groove and the projection.

4. The open-close apparatus according to claim 1, wherein the first member has the groove and the second member has the projection.

5. The open-close apparatus according to claim 1, wherein the groove has a fixed height portion and a sloped height portion.

6. The open-close apparatus according to claim 5, wherein:

when the movement of the first member is smaller than the predetermined amount, the projection is located in the fixed height portion of the groove and the moving speed of the first member is not limited, and when the movement of the first member is the same as or larger than the predetermined amount, the projection moves along the sloped height portion and the moving speed of the first member is limited.

7. The open-close apparatus according to claim 5, wherein the height varying portion has a slope.

8. An open-close apparatus comprising:

a first member provided with respect to an apparatus main body and movable between an open position and a close position of the apparatus main body, a second member movable with respect to the first member, and movably provided with respect to the apparatus main body;

a projection disposed on one of the first member and the second member; and a energizing unit that energizes the projection in a direction that increases a contact pressure between the first member and the second member, wherein when the first member moves from the close position to the open position, when a movement of the first member is the same as or larger than a predetermined amount from the close position, the contact pressure between the first member and the second member is larger than the contact pressure between the first member and the second member when the movement of the first member is smaller than the predetermined amount.

9. The open-close apparatus according to claim 8, wherein the energizing unit includes a spring, and an amount of retraction of the spring when a movement of the first member is the same as or larger than the predetermined amount is larger than the amount of retraction of the spring when the movement of the first member is smaller than the predetermined amount.

10. The open-close apparatus according to claim 8, wherein one of the first member and the second member has a groove, and the other member has a projection, and wherein the groove and the projection limit the moving speed of the first member by a friction force caused between the groove and the projection by an energizing force of the energizing unit.

11. The open-close apparatus according to claim 8, wherein one of the first member and the second member has a groove, and the other member has a projection, and wherein when the movement of the first member is smaller than the predetermined amount, the groove and the projection are not in contact with each other.

12. The open-close apparatus according to claim 8, wherein the contact pressure increases relative to an amount of movement of the first member.

13. An open-close apparatus comprising:

a first member provided with respect to an apparatus main body and movable between an open position and a close position of the apparatus main body, a second member movable with respect to the first member, and movably provided with respect to the apparatus main body; and a spring that urges the first member or the second member in a direction that increases a contact pressure between the first member and the second member, wherein when the first member moves from the close position to the open position, the spring increases the contact pressure between the first member and the second member when a movement of the first member is the same as or larger than a predetermined amount from the close position relative to when the movement of the first member is smaller than the predetermined amount.

14. The open-close apparatus according to claim 8, wherein one of the first member and the second member comprises a sloped surface along which a part of the other of the first member and the second member slides, and when the first member moves from the close position to the open position, the spring increases the contact pressure as the part of the other of the first member and the second member slides along the sloped surface.

15. An open-close apparatus comprising:

a first member movably provided with respect to a apparatus main body between an open position and a close position; and a second member movable with respect to a first member, and movably provided with respect to the apparatus main body;

a projection disposed on one of the first member and the second member; and a spring which biases the projection toward the other of the first member and the second member, wherein when the first member moves from the close position to the open position:

a friction force between the projection and the other of the first member and the second member caused by a movement of the first member being equal to or larger than a predetermined amount from the close position is larger than the friction force between the first member and the second member caused by the movement of the first member being smaller than the predetermined amount from the closed position.

16. The open-close apparatus according to claim 15, wherein the first member and the second member move about different supporting points with respect to the apparatus main body.

17. The open-close apparatus according to claim 15, wherein one of the first member and the second member has a surface, and the other of the first member and the second member has a projection, and the surface has a first end and a second end, and wherein when the first member moves from the close position to the open position, the moving speed of the first member is limited at a portion between the close position and the open position by the surface engaging the projection between the first end and the second end.

18. The open-close apparatus according to claim 17, wherein the surface has a first portion that is linear and a second portion that is continuous with the linear portion and extends in a different direction relative to the first portion.

19. The open-close apparatus according to claim 18, wherein when the first member moves from the close position to the open position:

when the movement of the first member is smaller than the predetermined amount from the close position, the projection is located along the first portion, and when the movement of the first member is the same as or larger than the predetermined amount from the close position, the projection is located along the second portion.

20. The open-close apparatus according to claim 18, wherein the second portion of the surface has a slope.

21. The open-close apparatus according to claim 17, wherein the first member has the surface and the second member has the projection.

22. The open-close apparatus according to claim 17, wherein the surface has a fixed height portion and a sloped height portion.

23. The open-close apparatus according to claim 22, wherein when the first member moves from the close position to the open position:

when the movement of the first member is smaller than the predetermined amount, the projection is located in the fixed height portion, and when the movement of the first member is the same as or larger than the predetermined amount, the projection is located in the sloped height portion.

* * * * *